340-566 SR
8/27/85 XR 4,538,139

United States Patent [19]

Clemente

[11] Patent Number: 4,538,139

[45] Date of Patent: Aug. 27, 1985

[54] SIGNALLING APPARATUS

[75] Inventor: Anthony R. Clemente, Malden, Mass.

[73] Assignee: Bolt Beranek and Newman Inc., Cambridge, Mass.

[21] Appl. No.: 373,524

[22] Filed: Apr. 30, 1982

[51] Int. Cl.[3] ..... G08B 1/08

[52] U.S. Cl. ..... 340/539; 340/545; 340/566; 340/590; 310/330

[58] Field of Search ..... 340/539, 545, 566, 590, 340/870.3; 73/774, 775, 812, DIG. 4; 310/330, 331, 332; 455/227, 228, 127

[56] References Cited

U.S. PATENT DOCUMENTS

| | | | |
|---|---|---|---|
| 3,553,588 | 1/1971 | Honig | 310/330 |
| 3,582,692 | 6/1971 | Palini | 310/330 |
| 3,614,760 | 10/1971 | Zimmet | 340/539 |
| 3,750,127 | 7/1973 | Ayers et al. | 310/330 |
| 3,781,836 | 12/1973 | Kruper et al. | 340/539 |
| 4,193,010 | 3/1980 | Kompanek | 310/330 |
| 4,197,479 | 4/1980 | Gudzin | 310/330 |
| 4,333,029 | 6/1982 | Kolm et al. | 310/332 |

*Primary Examiner*—Donnie L. Crosland
*Attorney, Agent, or Firm*—Henry D. Pahl, Jr.

[57] ABSTRACT

Signalling apparatus in which a sensed change in condition, e.g. a window opened by an intruder or a valuable art object moved, causes the free end of a cantilevered spring to be snapped or twanged. A piezoelectric film bonded to the spring generates a pulsating voltage which energizes a transmitter, independently of any external power source. Remotely, a receiver which is selectively responsive to the transmitted pulsating signal generates an output signal indicating the change in condition, e.g. for initiating an alarm.

6 Claims, 4 Drawing Figures

SIGNALLING APPARATUS

BACKGROUND OF THE INVENTION

The present invention relates to signalling apparatus and more particularly to an intrusion or theft alarm in which a self-powered sensor/transmitter signals to a remote receiver.

A great many types of burgular alarms have been developed for detecting intrusion into a protected space. In such systems where each possible entry point, window or door, is individually sensed as to opening and closing, the installation of the system has typically required that connecting wires be strung to each sensor. The cost of installing such wiring is very high and will typically even exceed the cost of the physical components of the system. While some so-called wireless systems are in use, they in fact require some source of electrical power.

While some theft detection systems utilize self-powered sensors which do not require wiring, the sensors do require the presence of an energizing r.f. field. These sensors typically operate by disturbing the applied r.f. field or utilizing received energy to re-transmit on a different frequency.

Among the several objects of the present invention may be noted the provision of apparatus for signalling remotely a sensed change in a local condition; the provision of such a system in which the sensor units do not require hard wired connection to the remote location; the provision of such a system in which the individual sensors do not require a separate electrical power source such as a battery; the provision of an improved intrusion or theft detector; the provision of such apparatus which is highly reliable and which is of relatively simple and inexpensive construction. Other objects and features will be in part apparent and in part pointed out hereinafter.

SUMMARY OF THE INVENTION

Briefly, signalling apparatus according to the present invention employs, at each sensing location, a spring cantilevered from a suitable base. A piezoelectric film is bonded to one face of the spring. Means are employed which, responsive to a sensed change in condition, twang the free end of the spring thereby causing the film to generate a pulsating voltage. An r.f. transmitter interconnected with the film and powered by the pulsating voltage radiates an r.f. signal modulated at a signalling frequency which is a function of the characteristic frequency of the spring. A receiver is then provided for detecting and demodulating the radiated r.f. signal and the demodulated signal is then applied to frequency selective means which responds to a frequency component at the signalling frequency for generating an output signal in response to its presence.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
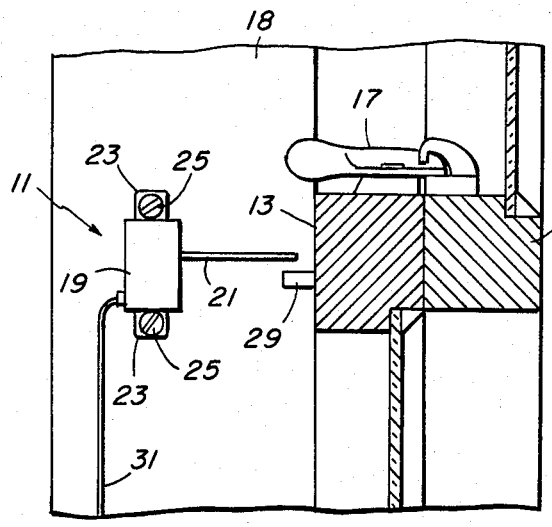
FIG. 1 is a diagrammatic view illustrating the typical installation of an intrusion sensor according to the present invention installed so as to sense the opening of a window.

Referring now to FIG. 1, a sensor constructed in accordance with the present invention is illustrated in a typical installation as an intrusion detector guarding a conventional double-hung window. The sensor is indicated generally by reference character 11. The window illustrated is of the usual double-hung variety comprising an inner sash 13 and an outer sash 15. A conventional sash lock is provided as indicated at 17. The sensor 11 is attached to the window frame 18.

The sensor 11 includes a body part 19 from which extends a flat cantilevered spring element 21. The body 19 is provided with mounting tabs 23 by means of which the sensor 11 can be secured to the window frame, e.g. by screws 25, as illustrated. The free end of the spring 21 extends into close proximity with the sash 13 and a pin 29 is installed on the sash in a position so that it will snap or twang the free end of the spring 21 if the window is opened. As indicated previously, the sensors in accordance with the present invention employ an r.f. transmitter. An antenna 31 cooperating with the transmitter extends from the base 19 as indicated at 31.

Figure 2:
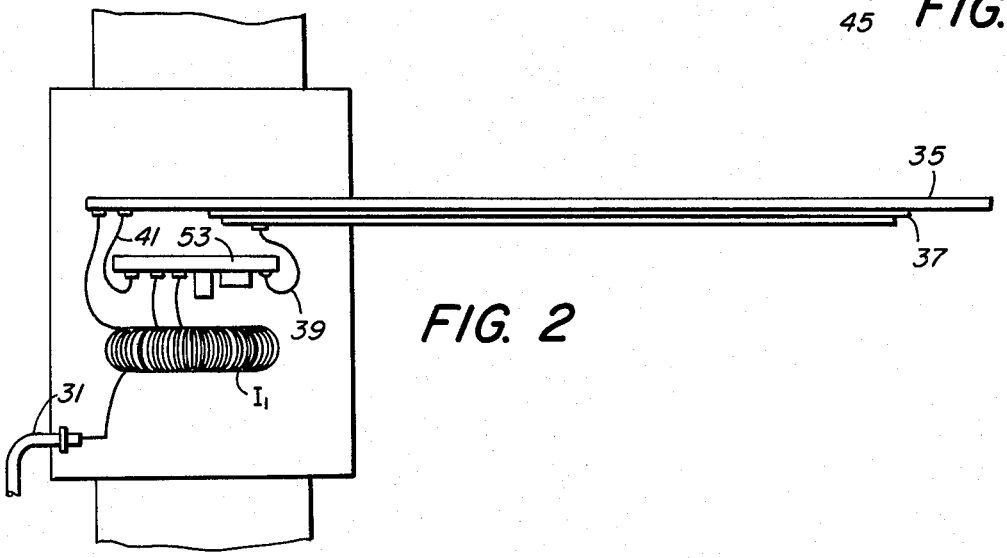
FIG. 2 is a view of the sensor of FIG. 1 with parts broken away.

The base 19 conveniently comprises a cast plastic block which both serves as a base or clamp for the fixed end of the cantilevered spring 21 and also serves as a potting or encapsulation for the transmitter components, the physical arrangement being illustrated in FIG. 2. The cantilevered spring 21 comprises a flat steel strip to which is bonded a piezoelectric film 37. A preferred material for the film 37 is polyvinylflouride ($PVF_2$). Appropriate film materials, complete with conductive face coatings suitable for electrical connection, are available from the 3M Company of St. Paul, Minnesota, and the Penwalt Corporation of King of Prussia, Penna. Film 37 is bonded to the steel strip 35 with a suitable adhesive such as a conventional strain gage adhesive so that the strip 35 forms one electrode for the piezoelectric action. A lead 39 is bonded to the other face of the film, e.g. by a suitable conductive epoxy.

When the free end of the spring element is snapped or twanged by the pin 29 upon opening of the sash 13, an oscillatory voltage is developed across the film 37 corresponding to the vibration of the spring. This voltage can be sensed between the lead 39 and the steel plate 35 and is used, as indicated previously, to power an r.f. transmitter.

Figure 3:
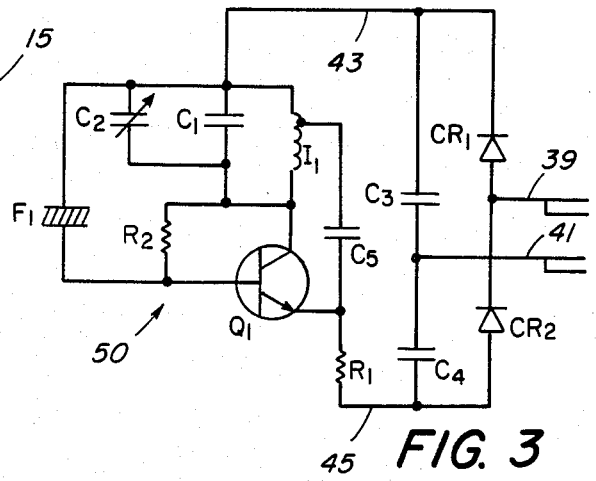
FIG. 3 is a circuit diagram of the r.f. transmitter employed in the sensor shown in FIGS. 1 and 2.

The diagram of a suitable transmitting circuit is illustrated in FIG. 3. The power supplying leads 39 and 41 are connected to what is essentially a voltage-doubling circuit comprising diodes CR1 and CR2 and capacitors C3 and C4. The values of capacitors C3 and C4 are such, however, that the voltage developed between supply leads 43 and 45 is not mainly d.c. but rather includes a very strong ripple component at twice the oscillatory frequency of the spring. The frequency doubling occurs as a function of the voltage-doubling circuit as will be understood by those skilled in the art. A crystal-controlled r.f. oscillator circuit, indicated generally by reference character 50, is connected across the supply leads 43 and 45 through a current-emitting resistor R1. The oscillator 50 is a conventional type of oscillator and, accordingly, is not described in detail herein. However, by way of example, the component values and/or types of the transmitter circuit are given in the following Table.

TABLE

| Component | Value and/or Type |
|---|---|
| K1 | 25,000 Ohms |
| K2 | 5,000,000 Ohms |
| C1 | 50 Picofarads |
| C2 | 10 Picofarads (variable) |
| C3 | 0.022 Microfarad |
| C4 | 0.022 Microfarad |
| C5 | 300 Picofarads |
| CR1 | 1N 4148 |
| CR2 | 1N 4148 |
| Q1 | 2N 218 |
| F1 | 45–188 Megahertz crystal |
| L1 | 300 Nanohenry |

As will be understood by those skilled in the art, these values and the oscillator design itself may vary considerably depending upon the particular application. Likewise, quite different oscillator and powering circuit designs may be easily substituted within the concept of the present invention.

In the embodiment illustrated, the transmitter circuit was in large part constructed as a hybrid circuit using conventional fabrication technology. The hybrid circuit substrate is indicated at 53 in FIG. 2 and most components of the circuit were mounted directly on this substrate with the exception of the coil I1 which is connected thereto by wire lead as well as to the antenna 31 and the steel plate 35 which acts as ground.

Figure 4:
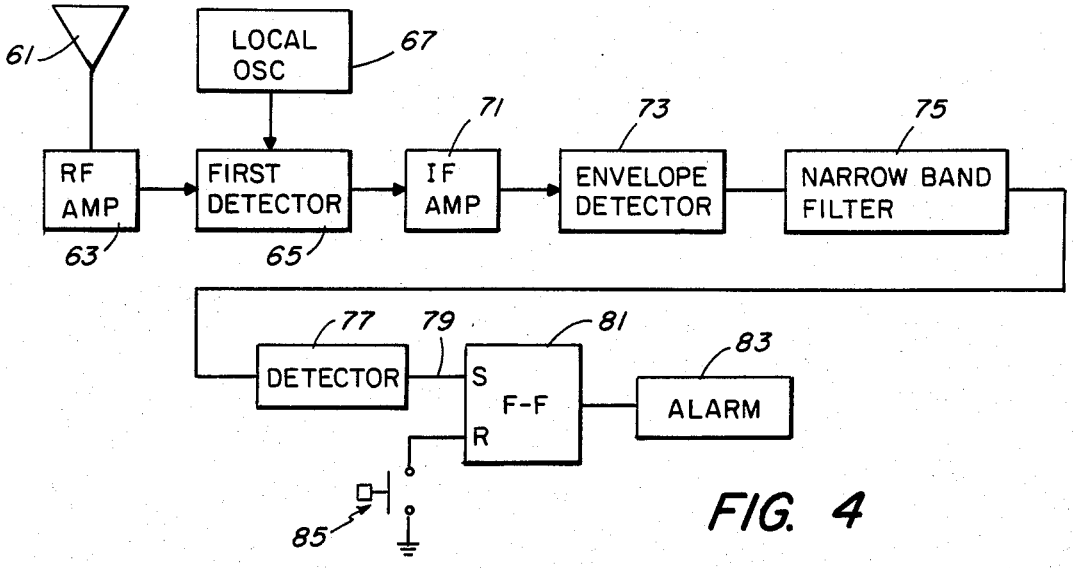
FIG. 4 is a block diagram of a receiver for generating an output or alarm signal in response to signals transmitted by a sensor of the type illustrated in FIGS. 1–3.

A block diagram of a suitable receiver for the signalling system is illustrated in FIG. 4. The first portion of the receiver is an essentially conventional superheterodyne design in which the r.f. signal picked up by an antenna 61 is amplified by an r.f. amplifier 63 and sent to a first detector 65 where it is combined with the signal from a local oscillator 67 to generate an intermediate frequency signal carrying essentially the same modulation. After amplification in an i.f. amplifier circuit 71, the modulation signal is detected by means of an envelope detector 73. In order to make the system very selectively responsive to the signals generated by the sensor of FIGS. 1–3, the modulation signal is applied to a narrow band filter 75 which is tuned to the signalling frequency.

In the embodiment illustrated, it will be understood that the signalling frequency is twice the resonant frequency of the spring element 21. The output signal from the filter 75 is provided to a final detector 77 which will generate an output signal on lead 79 if a significant signal component at the signalling frequency is detected. For the purposes of employing the signalling system as an intrusion detector, this output signal is conveniently applied at a flip-flop circuit 81 which, when set, energizes an alarm as indicated at 83. A push-button 85 is provided for manually resetting the flip-flop 81 to terminate the alarm state. As will be appreciated by those skilled in the art, a single receiver could monitor a large number of sensors of the type illustrated in FIGS. 1–3.

While a single signalling frequency has been shown by way of illustration, it should be understood that dual frequency signalling might also be provided to increase security against false alarms. For example, each sensor might comprise two springs having different resonant frequencies and the single transmitter could be powered by a combination of the two frequencies so that the modulated signal also comprises signalling components corresponding to the two frequencies. By then employing two corresponding filter circuits in the receiver and conditioning the setting of the alarm state upon the presence of both components, it will be understood that the likelihood of a false alarm can be significantly reduced.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Apparatus for signalling remotely a sensed change in a local condition; said apparatus comprising:

a base;

a flat metal spring cantilevered from said base;

bonded to a face of said spring, a piezoelectric film of polyvinylfluoride;

means response to the sensed change in condition for snapping the free end of said spring causing the spring to oscillate at its resonant frequency, thereby causing said film to generate a pulsating voltage;

means for rectifying and partially filtering said pulsating voltage thereby to provide a supply voltage having substantial ripple content at a frequency which is twice the characteristic resonant frequency of said spring frequency;

a crystal frequency controlled r.f. transmitter interconnected with said film and powered by said supply voltage to radiate an r.f. signal modulated at a signalling frequency which is essentially twice the characteristic resonant frequency of said spring;

a receiver for detecting and demodulating said radiated r.f. signal;

frequency selective means responsive to the demodulated signal for detecting and responding to a detected frequency component within the demodulated signal at essentially twice the resonant frequency of said spring and for generating an output signal in response thereto.

2. Apparatus as set forth in claim 1 wherein said receiver is a frequency selective superhetrodyne type.

3. Apparatus as set forth in claim 1 wherein the output signal provided by said frequency selective means initiates an alarm signal.

4. Apparatus as set forth in claim 3 wherein said apparatus includes latch means for continuing the alarm signal after the radiated r.f. signal from said transmitter dies out.

5. Apparatus for signalling remotely a sensed local movement; said apparatus comprising:

a base;

a flat metal spring cantelevered from said base;

bonded to a face of said spring, a piezoelectric film of polyvinylfluoride;

means responsive to the local movement for deflecting and then releasing the free end of said spring causing the spring to oscillate at its resonant frequency, thereby causing said film to generate a pulsating voltage;

means for rectifying and partially filtering said pulsating voltage thereby to provide a supply voltage having substantial ripple content at a frequency which is twice the characteristic resonant frequency of said spring frequency;

a crystal frequency controlled r.f. transmitter interconnected with said film and powered by said supply voltage to radiate an r.f. signal modulated at a signalling frequency which is essentially twice the characteristic resonant frequency of said spring;

a receiver for detecting and demodulating said radiated r.f. signal;

frequency selective means responsive to the demodulated signal for detecting and responding to a detected frequency component within the demodulated signal at essentially twice the resonant frequency of said spring and for generating an output signal in response thereto;

latch means which is set by said output signal; and alarm means operative when said latch is set.

6. Apparatus as set forth in claim 5 further comprising manually operable means for resetting said latch means.

* * * * *